US007052305B2

(12) United States Patent
Kurokawa

(10) Patent No.: US 7,052,305 B2
(45) Date of Patent: May 30, 2006

(54) POWER CORD PROTECTING FITTING AND ELECTRICAL APPLIANCE

(75) Inventor: Keiko Kurokawa, Iwatsuki (JP)

(73) Assignee: Fuji Xerox Co., Ltd, Tokyo (JP)

( * ) Notice: Subject to any disclaimer, the term of this patent is extended or adjusted under 35 U.S.C. 154(b) by 0 days.

(21) Appl. No.: 10/867,169

(22) Filed: Jun. 15, 2004

(65) Prior Publication Data

US 2005/0014413 A1 Jan. 20, 2005

(30) Foreign Application Priority Data

Jul. 11, 2003 (JP) ..... 2003-273362

(51) Int. Cl.
*H01R 13/62* (2006.01)

(52) U.S. Cl. ..... 439/371; 439/373

(58) Field of Classification Search ..... 439/371, 439/372, 373, 449, 459, 942; 174/53, 57, 174/66

See application file for complete search history.

(56) References Cited

U.S. PATENT DOCUMENTS 3,838,383 A * 9/1974 Wilbur et al. ..... 439/472
4,984,982 A * 1/1991 Brownlie et al. ..... 439/131
5,174,293 A * 12/1992 Hagiwara ..... 600/300
5,352,854 A * 10/1994 Comerci et al. ..... 174/65 R
5,469,844 A * 11/1995 Rogler ..... 600/300
6,200,155 B1 * 3/2001 Chudkosky et al. ..... 439/371
6,398,569 B1 * 6/2002 Boyd et al. ..... 439/258
6,485,316 B1 * 11/2002 Chen ..... 439/135
6,485,324 B1 * 11/2002 Belknap ..... 439/457
6,491,541 B1 * 12/2002 Wakino ..... 439/451
6,739,896 B1 * 5/2004 Sivertsen ..... 439/371
2003/0045159 A1 * 3/2003 Boudreaux ..... 439/449

OTHER PUBLICATIONS

Black & Decker, Instruction Manual, "Hedge Trimmer", Catalog No. TR165, Form No. 386048-02 Rev. 2, printed Jan. 2003, p. 1.

Little Wonder, Owner's Manual and Safety Instructions, Electric Hedge Trimmers, Single Edged Model No. 1910, 2410, 3010, 1912, 2412, 3012, Double Edged Model No. 1920, 2420, 3020, 1922, 2422, 3022, Document Reference No. P/N 310700, printed Jan. 2003, p. 6.

Remington, Owner's Manual, Hedge Wizard™ Electric Pole Trimmer, Model: 110946-01, Document Reference No. 110939-01 Rev. E, printed Oct. 2004, p. 5.

* cited by examiner

*Primary Examiner*—Hien Vu
(74) *Attorney, Agent, or Firm*—Morgan, Lewis & Bockius LLP

(57) ABSTRACT

A power cord protecting fitting applied to a power cord has a connecting member connected to an electrical appliance at one end thereof, and an insertion plug plugged in a wall outlet at another end thereof. The power cord protecting fitting is fixed to the electrical appliance and disposed between the connecting member and the insertion plug of the power cord, and has a force lightening unit that lightens a force transferred to the connecting member when a force is applied to the power cord between a position where the power cord protecting fitting is disposed and the insertion plug in a direction that moves away from the connecting member.

13 Claims, 10 Drawing Sheets

POWER CORD PROTECTING FITTING AND ELECTRICAL APPLIANCE

BACKGROUND OF THE INVENTION

1. Field of the Invention

The present invention relates to a power cord protecting fitting and an electrical appliance, and more particularly to a power cord protecting fitting for maintaining a normal connection between the electrical appliance and a power cord, and the electrical appliance.

2. Description of Related Art

In the case where electric power is supplied from a wall outlet to an electrical appliance, the two are connected by a power cord. Usually, the power cord and the electrical appliance are connected by directly coupling the power cord to the electrical appliance or plugging a plug included in the power cord into an inlet formed on the electrical appliance.

If the plug of the power cord is imperfectly connected to the inlet of the electrical appliance, or a break occurs as a result of the power cord being pulled or pressed against a wall, the connection between the power cord and the electrical appliance is not kept normal, with the result that the electrical appliance malfunctions. However, there has been no fitting for keeping normal the connection between a power cord and an electrical appliance.

SUMMARY OF THE INVENTION

The present invention has been made in view of the above circumstances and provides a power cord protecting fitting for keeping normal the connection between a power cord and an electrical appliance, and the electrical appliance equipped with the power cord protecting fitting.

To address the above-described problems, an aspect of the present invention provides a power cord protecting fitting applied to a power cord that has a connecting member connected to an electrical appliance at one end thereof, and an insertion plug plugged in a wall outlet at another end thereof. The power cord protecting fitting is fixed to the electrical appliance and disposed between the connecting member and the insertion plug of the power cord. The power cord protecting fitting has a force lightening unit that lightens a force transferred to the connecting member when a force is applied to the power cord between a position where the power cord protecting fitting is disposed and the insertion plug in a direction that moves away from the connecting member.

The connecting member refers to a member covering a joint for direct coupling of the power cord to the electrical appliance, and a plug that can be plugged in the inlet of the electrical appliance.

The power cord protecting fitting is fixed to the electrical appliance and disposed between the connecting member and the insertion plug of the power cord. When a force is applied to the power cord between the position where the power cord protecting fitting is disposed and the insertion plug in a direction that moves away from the connecting member, a force transferred to the connecting member is lightened by the force lightening unit. In other words, even if a force is applied to the power cord between the power cord protecting fitting and the insertion plug in a direction that moves away from the connecting member, the force is lightened by the force lightening unit before being transferred to the connecting member. Therefore, a load on the connecting member is lightened, so that it can be prevented that an imperfect connection or a break occurs as a result of the power cord being pulled, and a normal connection between the electrical appliance and the power cord can be maintained.

BRIEF DESCRIPTION OF THE DRAWINGS

The present invention will be described in detail based on the followings, wherein.

DETAILED DESCRIPTION OF THE INVENTION

Hereinafter, with reference to the drawings, a description is made for a power cord protecting fitting and an electrical appliance equipped with the power cord protecting fitting according to the present invention. Although, in this embodiment, an image forming apparatus 10 is described as an example of an the electrical appliance, an electrical appliance of the present invention is not limited to the image forming apparatus and is also applicable to other electrical appliances such as a refrigerator and a personal computer.

Figure 1:
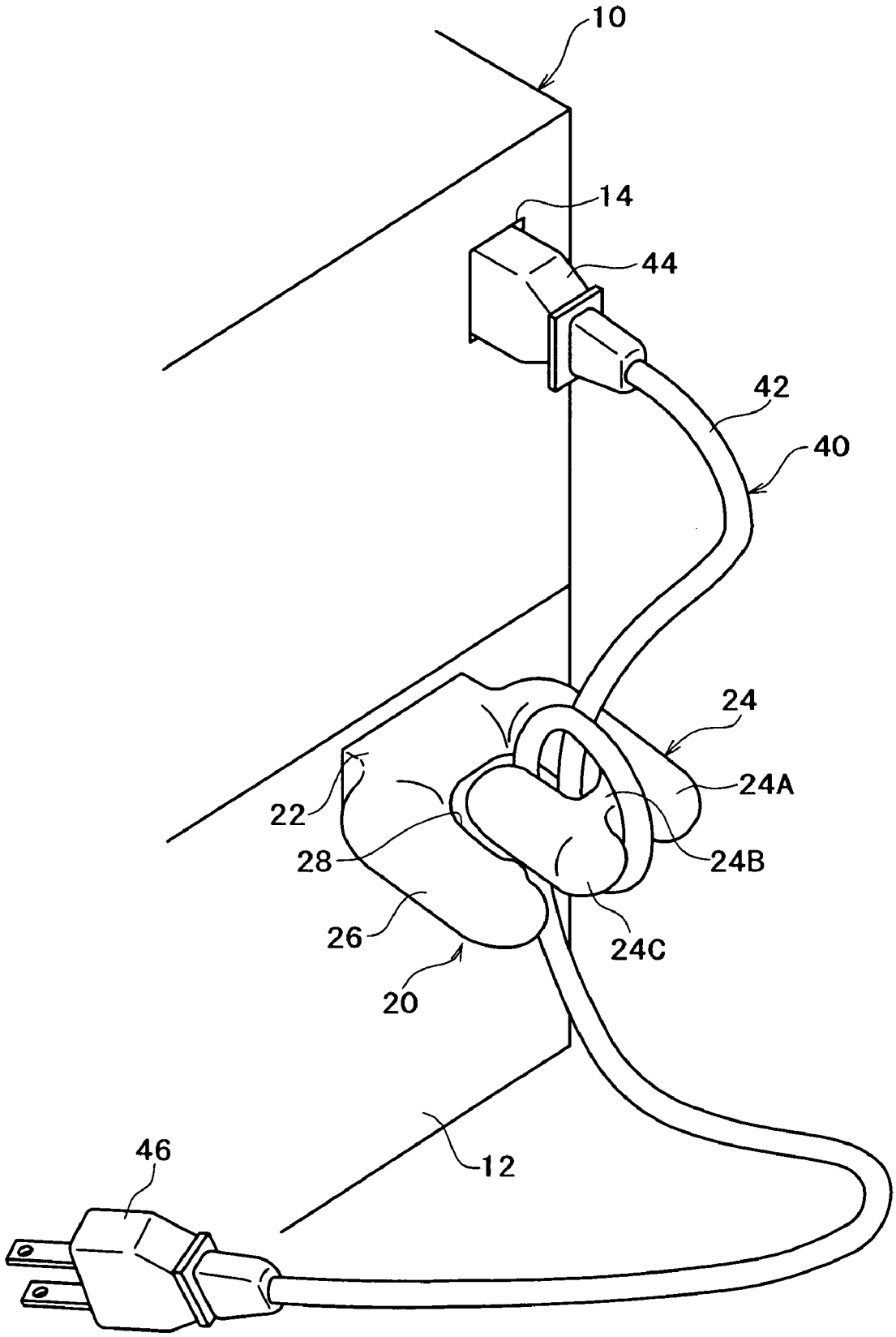
FIG. 1 is a perspective view showing the state in which a power cord protecting fitting of an embodiment is applied to a power cord.

A power cord protecting fitting 20 of the embodiment, as shown in FIG. 1, is applied to a power cord 40. The power cord 40 connects an outlet to the image forming apparatus 10 to supply power to the image forming apparatus 10. It includes a cord part 42, an inlet plug 44, and an outlet plug 46. The inlet plug 44 is connected to an inlet 14 (describes later) of the image forming apparatus 10. The outlet plug 46 is connected to a wall outlet that is not shown in the figure. Because the image forming apparatus is provided with a caster in the bottom thereof, it is freely movable. It can be freely mounted on a room wall, and the walls of a desk, a shelf, and the like. The back of the apparatus can be cleaned by freely moving the apparatus off the walls.

Figure 2:
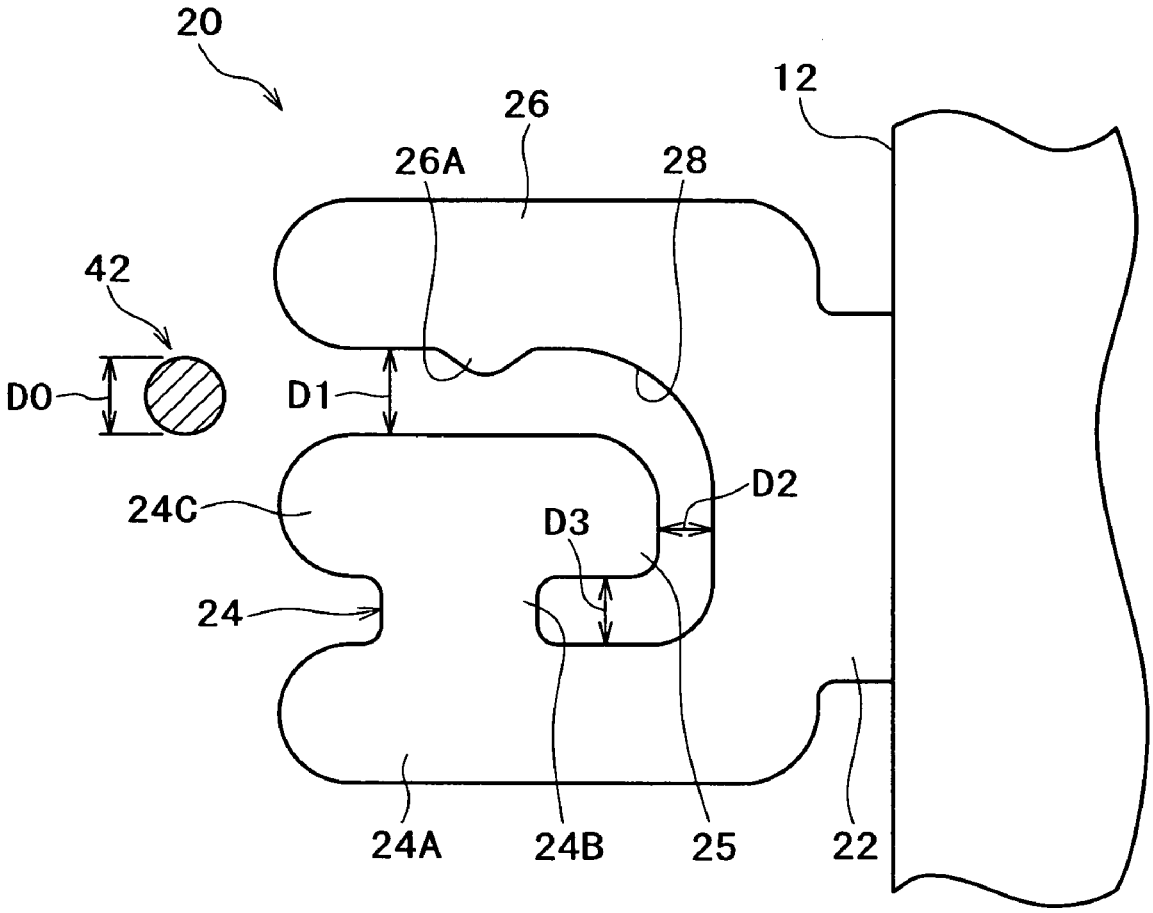
FIG. 2 is a top view of the power cord protecting fitting of the embodiment.

As shown in FIG. 2, the power cord protecting fitting 20 includes a base part 22, which is fixed to the image forming apparatus 10 by being bonded to its housing 12. A cord winding member 24 and a side pillar 26 are projected from the base part 22.

The cord winding member 24, which is in a substantially H shape, includes a first pillar part 24A, a middle part 24B, and a second pillar part 24C in that order from the base part 22. The first pillar part 24A forms one pillar of the H shape, the middle part 24B forms a middle part of the H shape, and the second pillar part 24C forms another pillar of the H shape. The rod-like first pillar part 24A, integrated with the base part 22, is projected in the direction of the normal to the housing 12 from the base part 22. The middle part 24B is disposed in a direction orthogonal to the first pillar part 24A and connected with the central part of the first pillar part 24A. The power cord 40 can be wound around the middle part 24B. The rod-like second pillar part 24C is disposed in parallel to the first pillar part 24A and its central part is connected with the middle part 24B. A corner part 25 is formed toward the base part 22 of the second pillar part 24C.

The rod-like side pillar 26 is projected in the direction of the normal to the housing 12 from the base part 22. The side pillar 26 is disposed toward the second pillar part 24C of the cord winding member 24. A convex part 26A is formed at the central part of the side pillar 26 a side of which faces the second pillar part 24C.

A cord passage 28 through which the cord part 42 can pass is formed among the second pillar part 24C of the cord winding member 24, the side pillar 26, the base part 22, and the first pillar part 24A. As shown in FIG. 2, a clearance D1 of the cord passage 28 that is formed by the side pillar 26 and the cord winding member 24 is wider than a diameter D0 of the cord part 42 of the power cord 40. On the other hand, a clearance D2 of the cord passage 28 that is formed by the side pillar 26 and the base part 22, and a clearance D3 of the cord passage 28 that is formed by the second pillar part 24C and the first pillar part 24A are narrower than the diameter D0 of the cord part 42, so that the power cord 40 can be sandwiched between the second pillar part 24C and the base part 22, or between the second pillar part 24C and the first pillar part 24A.

The corner part 25 of the second pillar part 24C is projected to the cord passage 28, so that a part of the clearance of the cord passage 28 is narrowed by the corner part 25. The convex part 26A of the side pillar 26 is projected to the cord passage 28, so that a part of the clearance of the cord passage 28 is narrowed by the convex part 26A.

The image forming apparatus 10 includes an inlet 14 for inputting power. The inlet plug 44 of the power cord 40 can be fitted in the inlet 14. It is desirable that the distance between the inlet 14 and the power cord protecting fitting 20 is short, preferably 200 mm or less. This is because, if the distance of the inlet 14 and the power cord protecting fitting 20 is shorter, the length of the cord part 42 from the inlet plug 44 to the power cord protecting fitting 20 in which the cord part 42 is wound can be made shorter, so that it can be prevented that a person or a thing is caught in the cord part 42 and a force is directly applied to the inlet plug 44.

Figure 3:
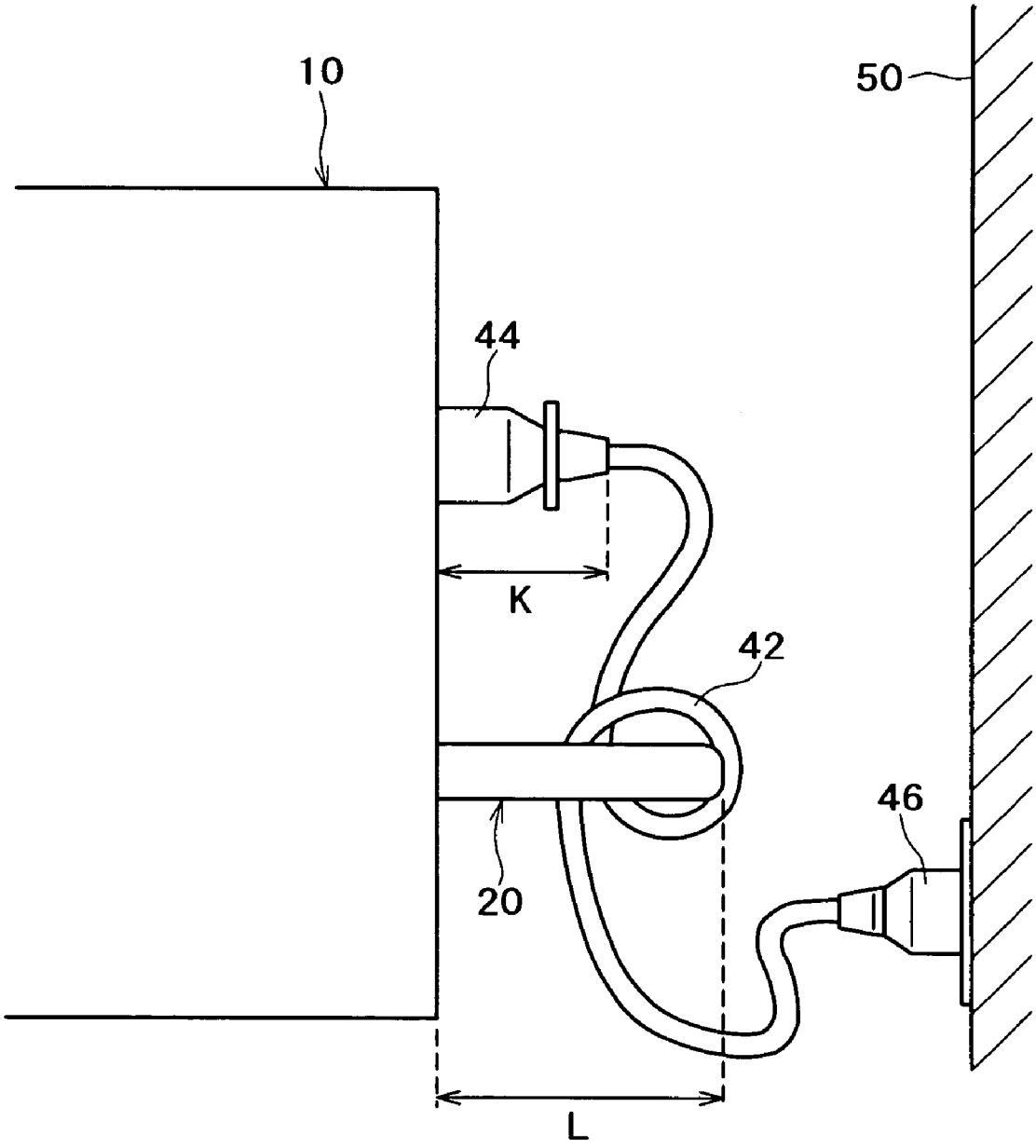
FIG. 3 is a side view showing how the power cord protecting fitting of the embodiment is used.

As shown in FIG. 3, the tips of the first pillar part 24A, the second pillar part 24C, and the side pillar 26 of the power cord protecting fitting 20 are projected beyond the inlet plug 44 in a direction opposite to the connecting direction of the inlet plug 44. In other words, the length L of the connection direction of the power cord protecting fitting 20 is longer than the lateral length K of the inlet plug 44 plugged in the inlet 14. With this construction, even if the image forming apparatus 10 is moved carelessly to a wall face 50, the power cord protecting fitting 20 strikes the wall face 50 but the inlet plug 44 does not strike the wall face 50. Therefore, it can be prevented that a break occurs as a result of the inlet plug 44 being caught in the space between the image forming apparatus 10 and the wall face 50.

In the case where the above-described power cord protecting fitting 20 is applied to the power cord 40, as shown in FIGS. 1 and 2, the cord part 42 of the power cord 40 is wound around the middle part 24B one turn. In this case, preferably, the cord part 42 is wound around the middle part 24B so that it hangs down naturally from the inlet plug 44 to the power cord protecting fitting 20. If much slack exists in the cord part 42 between the inlet plug 44 and the power cord protecting fitting 20, a person and a thing are liable to get caught in the cord part 42, and an excessive pull could cause a break. The cord part 42 is sandwiched between the first pillar part 24A and the second pillar part 24C of the power cord protecting fitting 20.

As described above, to the power cord 40 to which the power cord protecting fitting 20 is applied, if a force is applied between the power cord protecting fitting 20 and the outlet plug 46 in a direction that moves away from the inlet plug 44, the cord part 42 is tightened and the force is absorbed to the middle part 24B. As a result, the applied force is not transmitted directly to the inlet plug 44, and the load on the inlet plug 44 can be reduced, so that it can be prevented that the inlet plug 44 is imperfectly connected or a break occurs due to an excessive weight.

Because the corner part 25 is formed in the second pillar part 24C of the power cord protecting fitting 20, the cord part 42 has difficulty in passing through the portion of the cord passage 28 narrowed by the corner part 25, so that it is prevented that the cord part 42 is disengaged from the middle part 24B. Even if the cord part 42 passes through the portion of the cord passage 28 narrowed by the corner part 25, because the convex part 26A is formed in the side pillar 26, it prevents the cord part 42 from moving to the outside of the cord passage 28.

Figure 4:
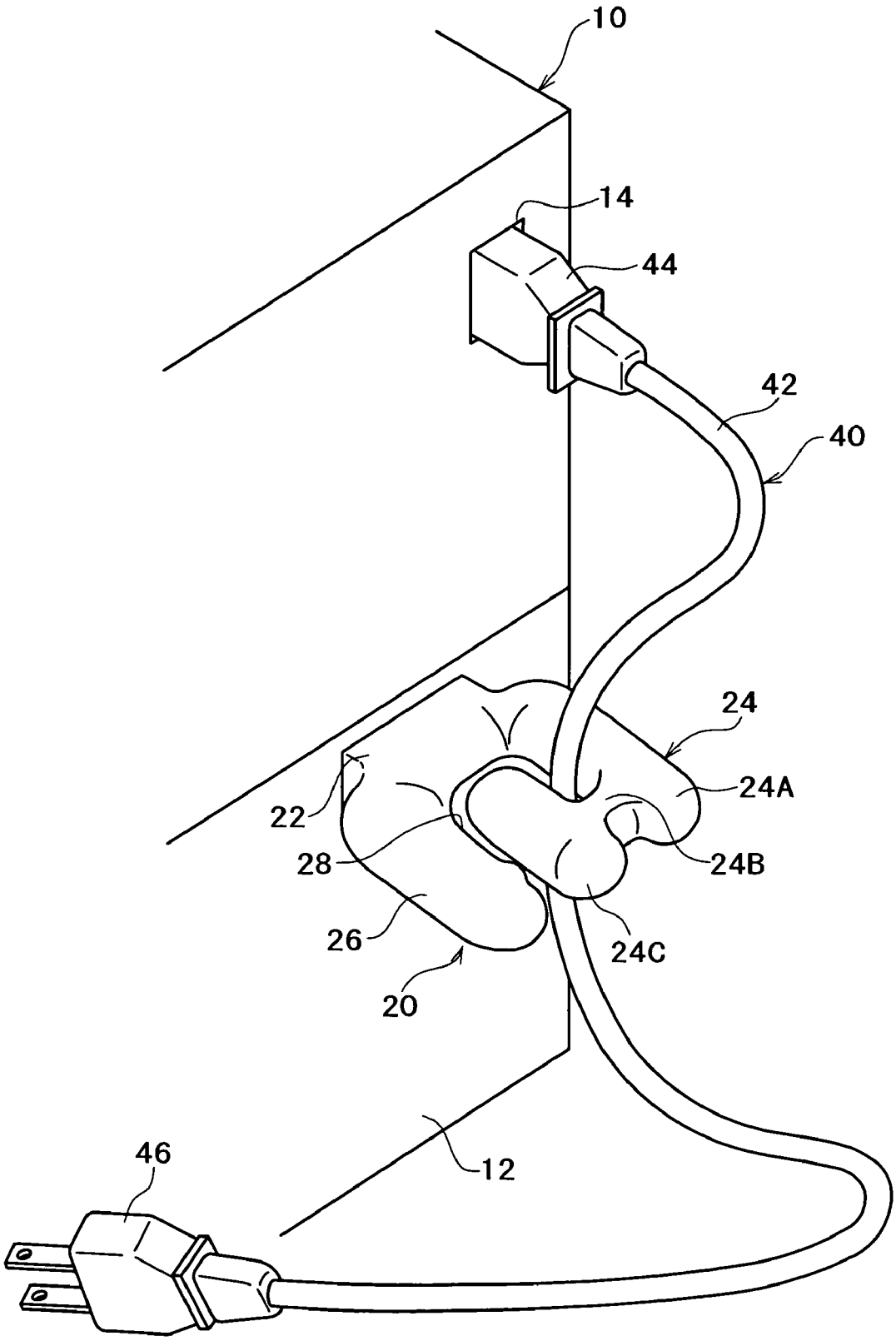
FIG. 4 is a perspective view showing another example of application of the power cord protecting fitting of the embodiment to a power cord.

In this embodiment, the cord part 42 of the power cord 40 is wound around the middle part 24B one turn. The cord part 42 does not necessarily need to be wound around the middle part 24B. As shown in FIG. 4, it may be only inserted between the first pillar part 24A and the second pillar part 24C. Even in this case, because the cord part 42 is sandwiched between the first pillar part 24A and the second pillar part 24C, when the same force as described above is applied to the cord part 42, the applied force is absorbed to the first pillar part 24A and the second pillar part 24C because of friction among the first pillar part 24A, the second pillar part 24C, and the cord part 42. Therefore, the applied force is not transferred directly to the inlet plug 44, so that the load on the inlet plug 44 can be reduced.

Figure 5:
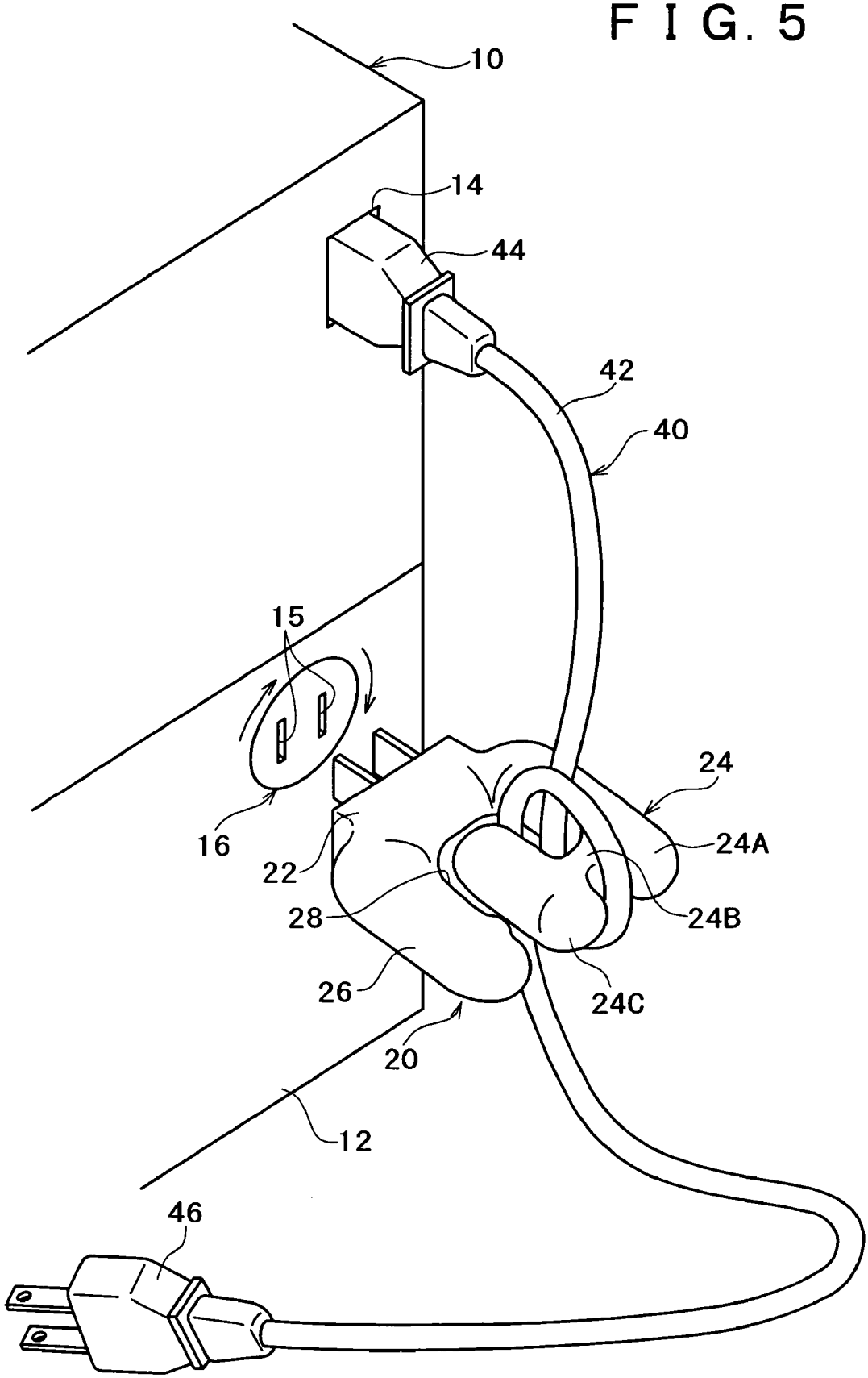
FIG. 5 is a perspective view showing a variant of attachment of the power cord protecting fitting of the embodiment to an image forming apparatus.

In the embodiment, by bonding the power cord protecting fitting 20 to the housing 12, the power cord protecting fitting 20 is fixed to the image forming apparatus 10. However, other methods may be employed to fix the power cord protecting fitting 20 to the image forming apparatus 10. For example, the housing 12 and the power cord protecting fitting 20 may be engaged with each other, or the power cord protecting fitting 20 may be integrated with the housing. In the case where the housing 12 and the power cord protecting fitting 20 are engaged with each other, for example, as shown in FIG. 5, a plug plate 23 is projected from the base part 22 of the power cord protecting fitting 20, and the image forming apparatus 10 is provided with a receptacle 16 with plug holes 15 formed. The plug plate 23 can be plugged in the plug holes 15. After plugging the plug plate 23 in the plug holes 15, by turning the receptacle 16, the plug plate 23 is locked. By this construction, the power cord protecting fitting 20 can be fixed to the image forming apparatus 10, and by unlocking the plug plate 23, it can be removed from the image forming apparatus 10.

Figure 6:
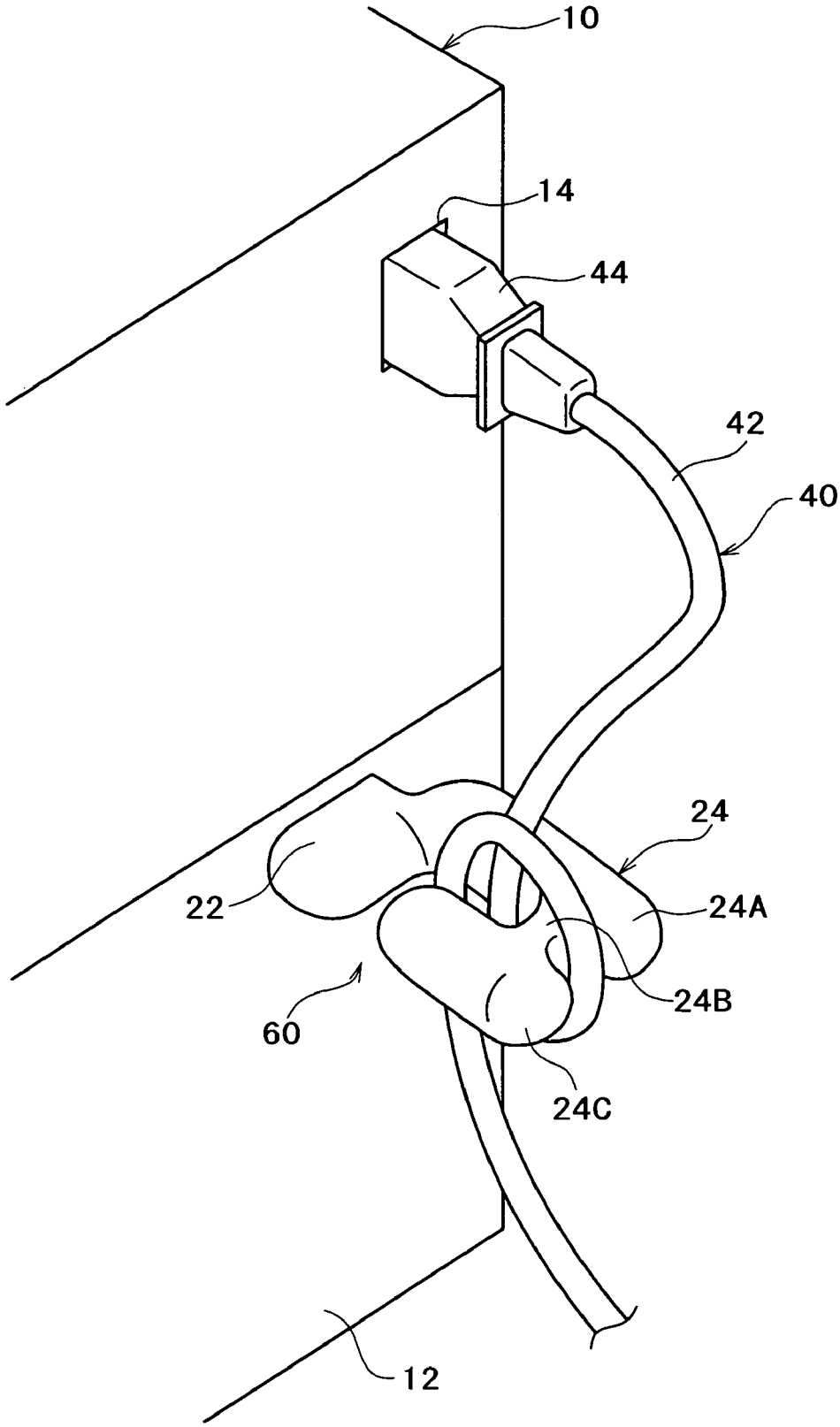
FIG. 6 is a perspective view showing a variant of the power cord protecting fitting of the embodiment.
Figure 7:
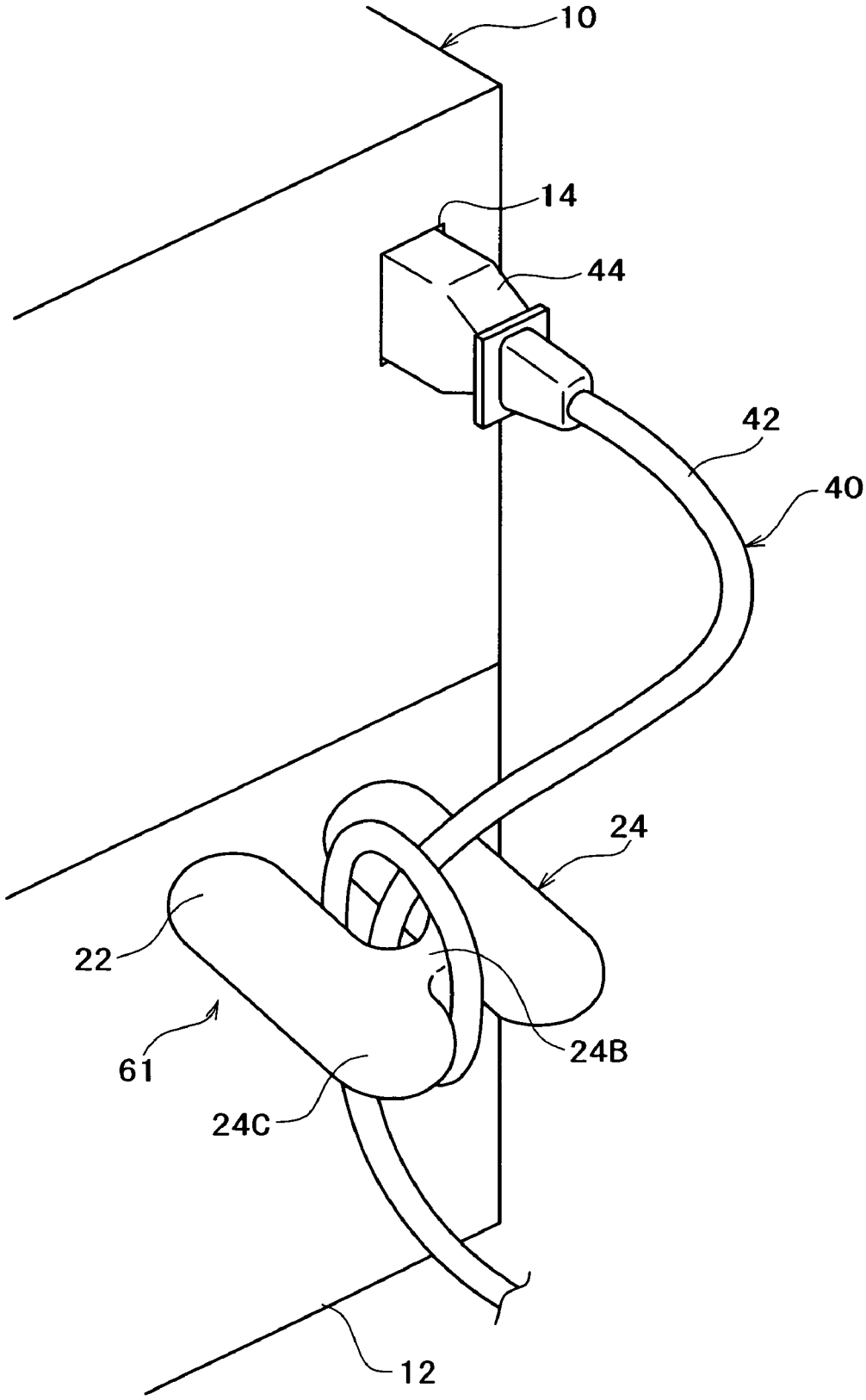
FIG. 7 is a perspective view showing another variant of the power cord protecting fitting of the embodiment.

The side pillar 26 of this embodiment is not necessarily required. Like a power cord protecting fitting 60 shown in FIG. 6, the side pillar 26 may be excluded. Furthermore, the base part 22 is not necessarily required, and like a power cord protecting fitting 61 shown in FIG. 7, the cord winding member 24 may be fixed directly to the image forming apparatus 10.

Figure 8:
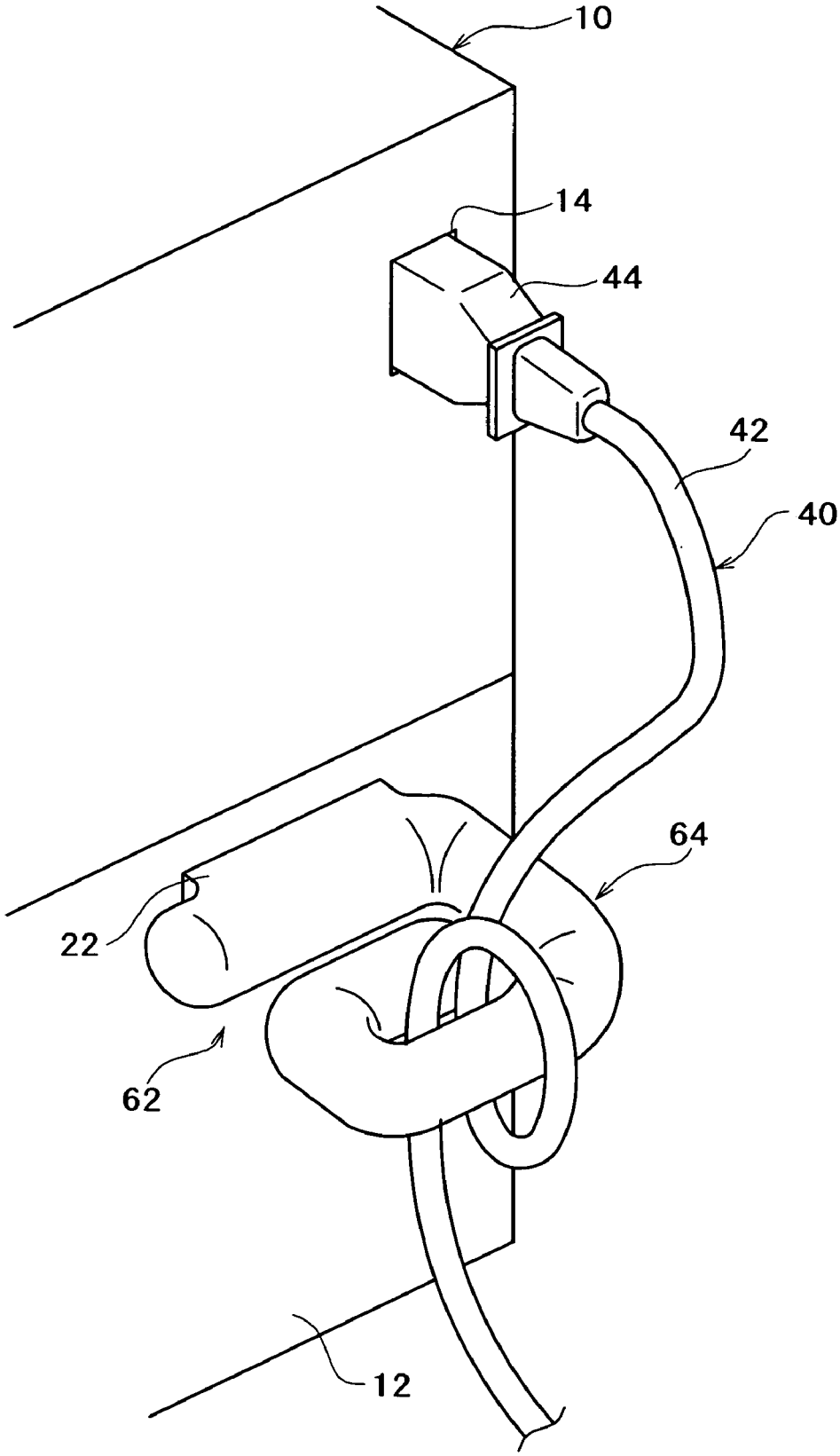
FIG. 8 is a perspective view showing another variant of the power cord protecting fitting of the embodiment.
Figure 9:
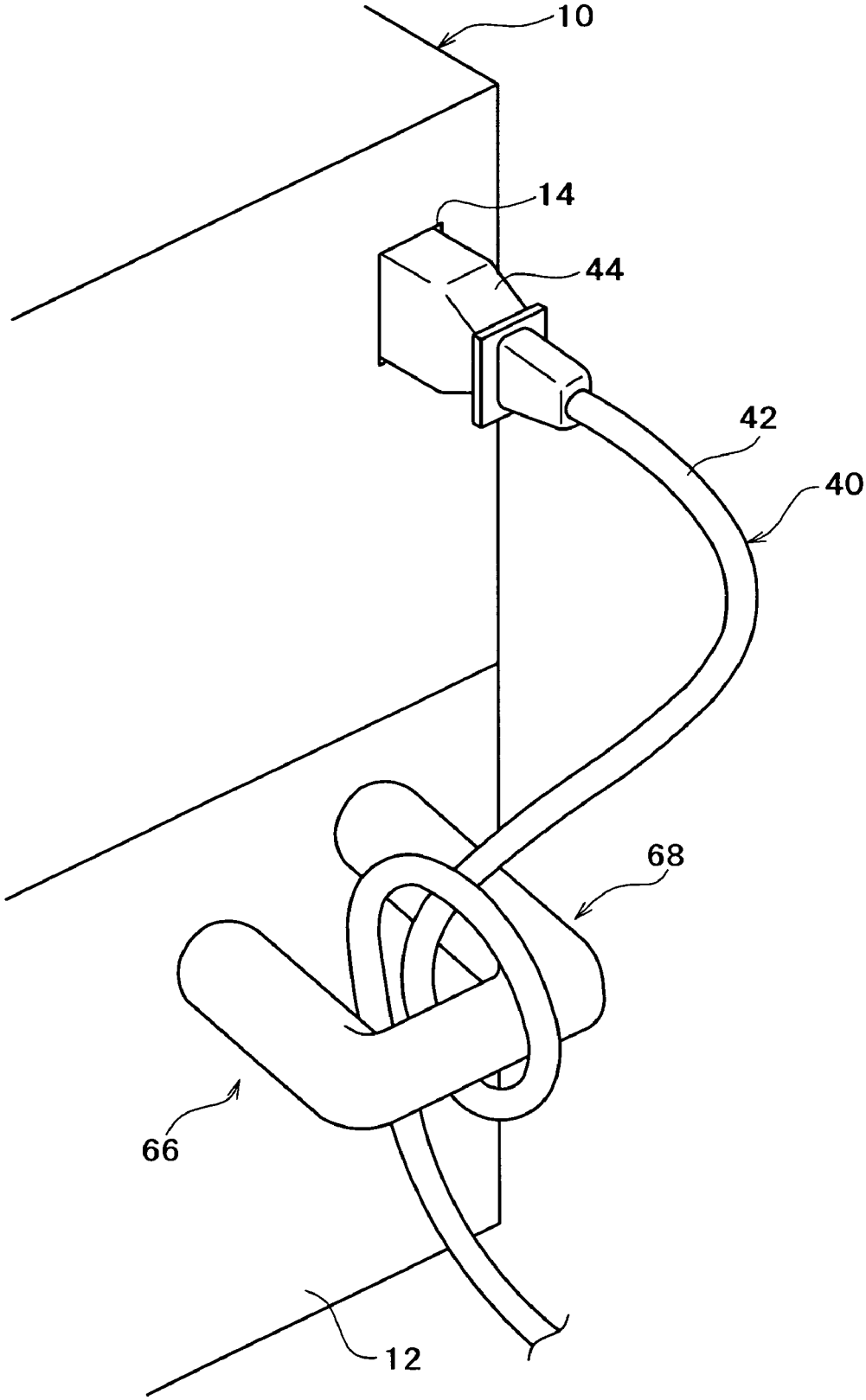
FIG. 9 is a perspective view showing another variant of the power cord protecting fitting of the embodiment.

Although, in the embodiment, the cord winding member 24 is in a substantially H shape, it is not limited to this shape. For example, like a power cord protecting fitting 62 shown in FIG. 8, a cord winding member 64 may be in a spiral shape. Furthermore, like a power cord protecting fitting 66 shown in FIG. 9, a cord winding member 68 may be formed into a shape similar to "U" to fix the cord winding member 68 directly to the image forming apparatus 10.

Figure 10:
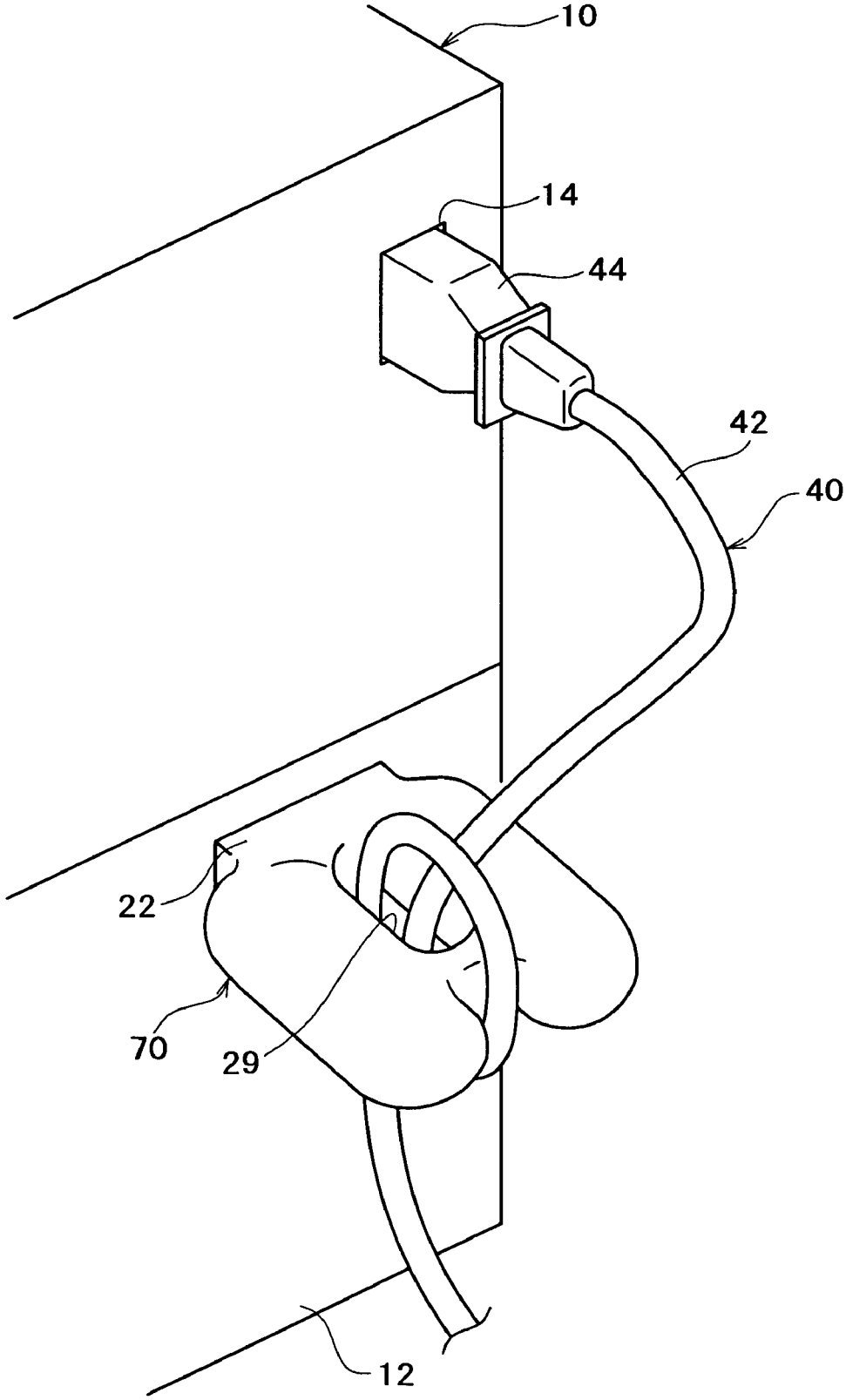
FIG. 10 is a perspective view showing another variant of the power cord protecting fitting of the embodiment.

In the embodiment, the cord passage 28 is formed which allows the cord part 42 to pass through. However, alternatively, like a power cord protecting fitting 70 shown in FIG. 10, in place of the cord passage 28, a cord hole 29 in which the cord part 42 can be inserted may be formed. This construction prevents the cord part 42 from going out of the cord hole 29. In this case, because it is difficult for the inlet plug 44 and the outlet plug 46 to pass through the cord hole 29, it is necessary to beforehand wind the power cord 40 around the power cord protecting fitting 70.

As described so far, according to the power cord protecting fitting of an aspect of the present invention, even if a force is applied to the power cord between the power cord protecting fitting and the insertion plug in a direction that moves away from the connecting member, the force is lightened by the force lightening unit before being transferred to the connecting member. Therefore, a load on the connecting member is lightened, so that it can be prevented that the power cord is imperfectly connected or broken as a result of being pulled, and a normal connection between the electrical appliance and the power cord can be maintained.

According to the power cord protecting fitting of another aspect, because the projection part strikes a wall face or the like, it can be prevented that the connecting member strikes the wall face or the like, so that it can be prevented that a break occurs as a result of the connecting member being sandwiched between the electrical appliance and the wall face. As a result, the connection between the power cord and the electrical appliance can be kept normal.

The entire disclosure of Japanese Patent Application No. 2003-273362 filed on Jul. 11, 2003 including specification, claims, drawings and abstract is incorporated herein by reference in its entirety.

What is claimed is:

1. A power cord protecting fitting applied to a power cord having a connecting member connected to an electrical appliance at one end thereof, an insertion plug to be plugged in a wall outlet at another end thereof, and a middle portion wound around the power cord protecting fitting disposed at a distance apart from the electrical appliance, the power cord protecting fitting, while being fixed to the electrical appliance and disposed between the connecting member and the insertion plug of the power cord, comprising a force reducing unit around which the middle portion of the power cord is wound to reduce a force transferred to the connecting member when a force is applied to the power cord between a position where the power cord protecting fitting is disposed and the insertion plug in a direction that moves away from the connecting members, wherein the force reducing unit comprises a cord winding member including a base connected to the electrical appliance, a first pillar part extending from the base, a second pillar part substantially parallel to the first pillar part, and a connection part connecting the first pillar and the second pillar parts wherein the middle portion of the power cord is disposed between the first and second pillar parts and wound around the connection part.

2. The power cord protecting fitting according to claim 1, further comprising a convex part positioned in a gap formed between a side pillar and the second pillar part that prevents the portion of the power from being freed.

3. The power cord protecting fitting according to claim 1, further comprising a disengagement preventing member that prevents the portion of the power cord wound around the cord winding member from being disengaged from the cord winding member.

4. A power cord protecting fitting applied to a power cord having a connecting member connected to an electrical appliance at one end thereof, an insertion plug plugged in a wall outlet at another end thereof, and a middle portion wound around the power cord protecting fitting disposed at a distance apart from the electrical appliance such that power cord protecting fitting is disposed the between the connecting member and the insertion plug of the power cord, the power cord protecting fitting comprising:

a fixing part fixed to the electrical appliance;

projection part projected beyond the connecting member connected to the electrical appliance in a direction opposite to the connecting direction of the connecting member; and a force reducing unit including a cord winding member having a base connected to the electrical appliance, a first pillar part extending from the base, a second pillar part, and a connection part connecting the first and second pillar parts wherein the middle portion of the power cord is disposed between the first and second pillar parts and wound around the connection part of the force reducing unit to reduce a force transferred to the connecting member when a force is applied to the power cord between a position where the power cord protecting fitting is disposed and the insertion plug in a direction that moves away from the connecting member.

5. The power cord protecting fitting according to claim 4, wherein the electrical appliance has a caster and is movable.

6. The power cord protecting fitting according to claim 4, further comprising a convex part positioned in a gap formed between a side pillar and the second pillar part that prevents the portion of the power cord from being freed.

7. The power cord protecting fitting according to claim 4, further comprising a disengagement preventing member that prevents the portion of the power cord wound around the cord winding member from being disengaged from the cord winding member.

8. An electrical appliance, comprising:

a power cord protecting fitting applied to a power cord that has a connecting member connected to the electrical appliance at one end thereof, an insertion plug to be plugged in a wall outlet at another end thereof, and a middle portion passing through and constrained by the power cord protecting fitting disposed at a distance apart from the electrical appliance, wherein the power cord protecting fitting, while being fixed to the electrical appliance and disposed between the connecting member and the insertion plug of the power cord, comprises a force reducing unit around which the middle portion of the power cord is wound to reduce a force transferred to the connecting member when a force is applied to the power cord between a position where the power cord protecting fitting is disposed and the insertion plug in a direction that moves away from the connecting member, wherein the force reducing unit includes a cord winding member having a base connected to the electrical appliance, a first pillar part extending from the base, a second pillar part substantially parallel to the first pillar part, and a connection part connecting the first pillar and the second pillar parts wherein the middle portion of the power cord is disposed between the first and second pillar parts and wound around the connection part.

9. The electrical appliance according to claim 8, wherein a distance between a connection part to which the power cord is connected, and the power cord protecting fitting is 200 mm or less.

10. An electrical appliance for use with a power cord having a connecting member at one end thereof inserted into the electrical appliance in a connecting direction, an insertion plug plugged into a wall outlet at another end thereof, and a middle portion wound interconnecting the connection member and the insertion plug, the electrical appliance comprising:

a housing;

a power cord protecting fitting fixed to the housing such that the power cord is wound around the power cord protecting fitting, and a portion of the power cord protecting fitting projects in a direction opposite to the connecting direction of beyond the connecting member, wherein the power cord protecting fitting includes a cord winding member having a base connected to the electrical appliance, a first pillar part extending from the base, a second pillar part substantially parallel to the first pillar part, and a connection part connecting the first pillar and the second pillar parts wherein the middle portion of the power cord is disposed between the first and second pillar parts and wound around the connection part.

11. The electrical appliance according to claim 10, wherein the electrical appliance is movable.

12. A power cord protecting fitting attached to an electrical apparatus for protecting a power cord from being pulled from the electrical appliance, comprising:

a base portion connected to the electrical appliance;

a first pillar portion projecting from a first side of the base portion;

a second pillar portion projected from a second side of the base portion, the second pillar portion being substantially parallel to the first pillar portion; and a third pillar portion disposed substantially parallel to the first pillar portion between the first and second pillar portions and connected to the first pillar portion by a connection portion, wherein at least a portion of a gap defined between the third pillar portion and at least one of the first pillar portion, the second pillar portion and the base portion is less than a diameter of the middle portion of the power cord to retain the power cord, and wherein the first pillar portion and the connecting portion are sufficiently flexible to permit the power cord to be inserted between the first and third pillar portions.

13. The power cord protecting filling according to claim 12, further comprising a convex part formed extending from the second pillar portion to prevent the power cord retained in the gap from becoming freed.

* * * * *